US005494333A

United States Patent [19]

Wilson

[11] Patent Number: 5,494,333

[45] Date of Patent: Feb. 27, 1996

[54] HILLSIDE CHAIR

[76] Inventor: Barry E. Wilson, 817 Hillary Ct., Lawrenceville, Ga. 30243

[21] Appl. No.: 263,185

[22] Filed: Jun. 21, 1994

[51] Int. Cl.[6] ..... A47C 3/20; A47C 4/00

[52] U.S. Cl. ..... 297/344.18; 297/451.2; 297/188.14; 297/35; 248/188.5

[58] Field of Search ..... 297/344.18, 325, 297/194, 445, 446, 448, 40, 41, 35, 188.4; 248/188.5, 188.9, 188.8

[56] References Cited

U.S. PATENT DOCUMENTS

| | | | |
|---|---|---|---|
| 1,973,226 | 9/1934 | Rose et al. | 248/188.9 X |
| 2,128,522 | 8/1938 | Burns et al. | 165/88 |
| 2,649,135 | 8/1953 | Eames | 297/445 |
| 3,006,673 | 10/1961 | Swick | 248/188.8 X |
| 3,099,103 | 7/1963 | Wright | 248/188.8 X |
| 3,624,814 | 11/1971 | Borichevsky et al. | 297/445 |
| 3,659,898 | 5/1972 | Yellin | 297/445 |
| 4,029,278 | 6/1977 | Napoleon | 248/188.2 |
| 4,772,068 | 9/1988 | Gleckler et al. | 297/39 |
| 4,832,296 | 5/1989 | Schnepp | 248/188.5 X |
| 4,948,197 | 8/1990 | Sansing | 297/344.18 |
| 5,060,896 | 10/1991 | Hobbins | 297/344.18 |
| 5,207,477 | 5/1993 | Maxwell | 297/194 |
| 5,246,265 | 9/1993 | Nagan et al. | 297/54 |

*Primary Examiner*—Peter M. Cuomo
*Assistant Examiner*—Anthony D. Barfield
*Attorney, Agent, or Firm*—Kenneth S. Watkins, Jr.

[57] ABSTRACT

A folding chair is disclosed which can be used on sloping or uneven terrain. Individually adjustable legs and leveling feet provide flexibility of use, comfort, and stability where ordinary folding chairs cannot be used. In an alternative embodiment, ball and socket leveling feet are used to level the feet and distribute the leg loads. Grooved resilient pads on the bottom of the feet prevent slippage on hard surfaces such as rock or concrete. Closable storage compartments are provided in the arms for storage of small items,

4 Claims, 6 Drawing Sheets

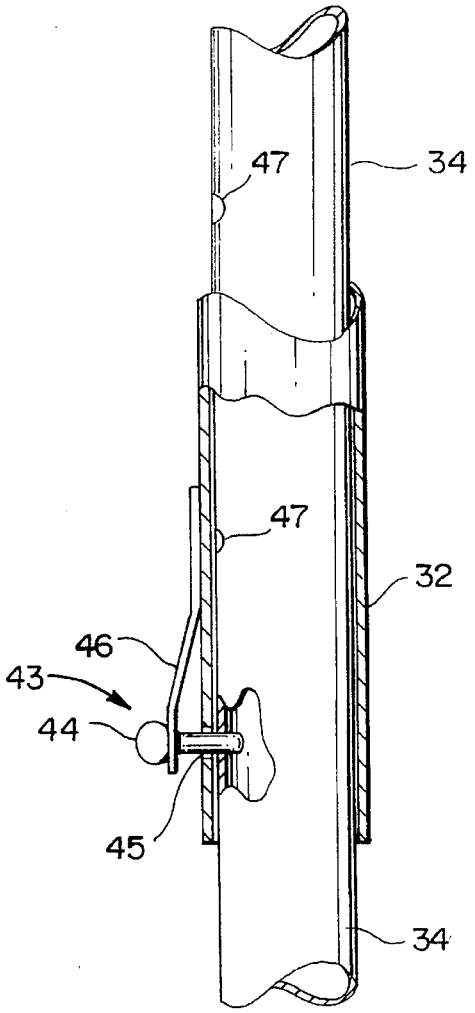
FIG. 3
FIG. 7
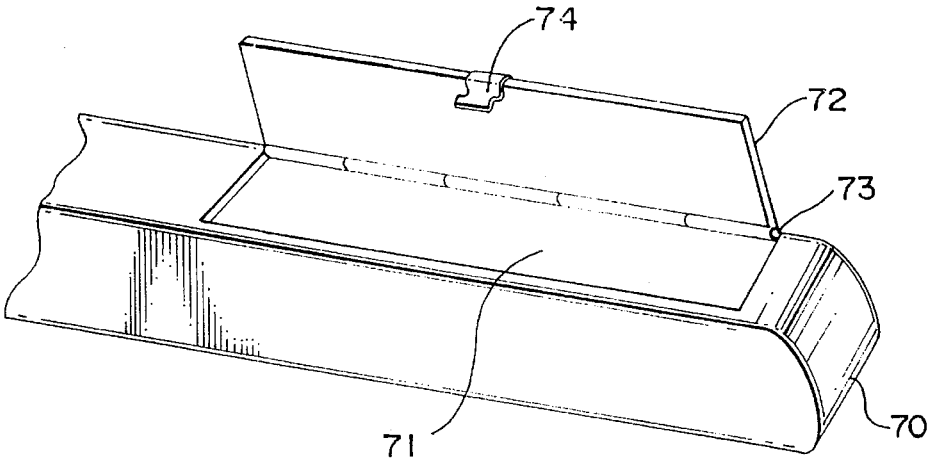

HILLSIDE CHAIR

BACKGROUND OF THE INVENTION

The present invention relates to a chair for use on uneven surfaces.

Currently available folding chairs are designed to be used on level, even terrain. Any attempt to use the commonly available folding chair on sloping or uneven terrain places the user at risk of sliding or tipping over. Barring such a catastrophic accident, the user is still subjected to sitting at an odd, uncomfortable angle that matches the slope of the terrain upon which the chair is placed. This deficiency in current folding chairs precludes the use of a chair in many common outdoor settings, such as on hillsides overlooking sporting fields, river banks and lake banks.

A number of devices have been disclosed in the past to address one or more of the problems with common folding chairs. A device disclosed by Gleckler in U.S. Pat. No. 4,772,068 is a chair intended for use on sloping terrain. This device employs a single, adjustable "U"-shaped extension at the rear of the chair to achieve front-to-rear leveling. A complicated arrangement of screw-adjusted, oppositely opposed arms is intended to provide leveling for using the chair transversely on a slope. This device also lacks the protection against rocking and slipping.

A device disclosed by Burns et al. in U.S. Pat. No. 2,128,522 provides for adjustment of two of its four legs individually. This device, however, was intended for indoor, theater use and provided for adjusting only two of its four legs. Even if modified for outdoor use, this device lacks flexibility for leveling on uneven or transversely sloping terrain.

OBJECTS OF THE INVENTION

Therefore, one objective of the present invention is to provide easy-to-use, individually adjustable legs on a folding chair such that the chair can be safely used on a variety of terrain. In the preferred embodiment, the chair would have three legs to simplify adjustment and reduce rocking.

Another objective of the present invention is to provide leveling feet on the chair legs to increase the stability of the chair on uneven terrain or soft ground.

A further objective of the present invention is to provide a resilient bottom surface, which can be grooved, to improve the grip on hard surfaces such as rock, stone, or concrete.

An objective of an alternative embodiment of the present invention is to further enhance the stability of the hillside chair by providing four legs instead of three.

Yet another objective is to provide a chair with an enclosed storage space to store frequently used items.

SUMMARY OF THE INVENTION

The present invention is a chair for use on uneven surfaces which addresses the shortcomings of previous designs and current technology. The device comprises a seat to form a seating surface, a back to provide back support for a user, two arms to support the arms of a user, at least three legs to support the chair, an individual length adjustment means to individually adjust the length of at least one leg, a leveling foot on each leg for distributing leg load over an area, and a folding means for positioning the chair elements in close proximity for transportation and storage.

In the preferred embodiment of the present invention, the chair has three legs, all of which are adjustable in length, and the leveling feet have a grooved, resilient gripping surface bonded to their bottoms.

In an alternative embodiment, the chair has four legs.

In another alternative embodiment, the leveling feet are attached to the legs with ball and socket joints.

BRIEF DESCRIPTION OF THE DRAWINGS

These and other features, aspects, and advantages of the present invention will become better understood with regard to the following description, appended claims, and accompanying drawings where:

FIG. 3 is a detail of the leg locking pin mechanism;

FIG. 7 is a perspective of an alternative arm design incorporating a storage area.

DETAILED DESCRIPTION

The following description discloses a chair for use on uneven surfaces.

Figure 1:
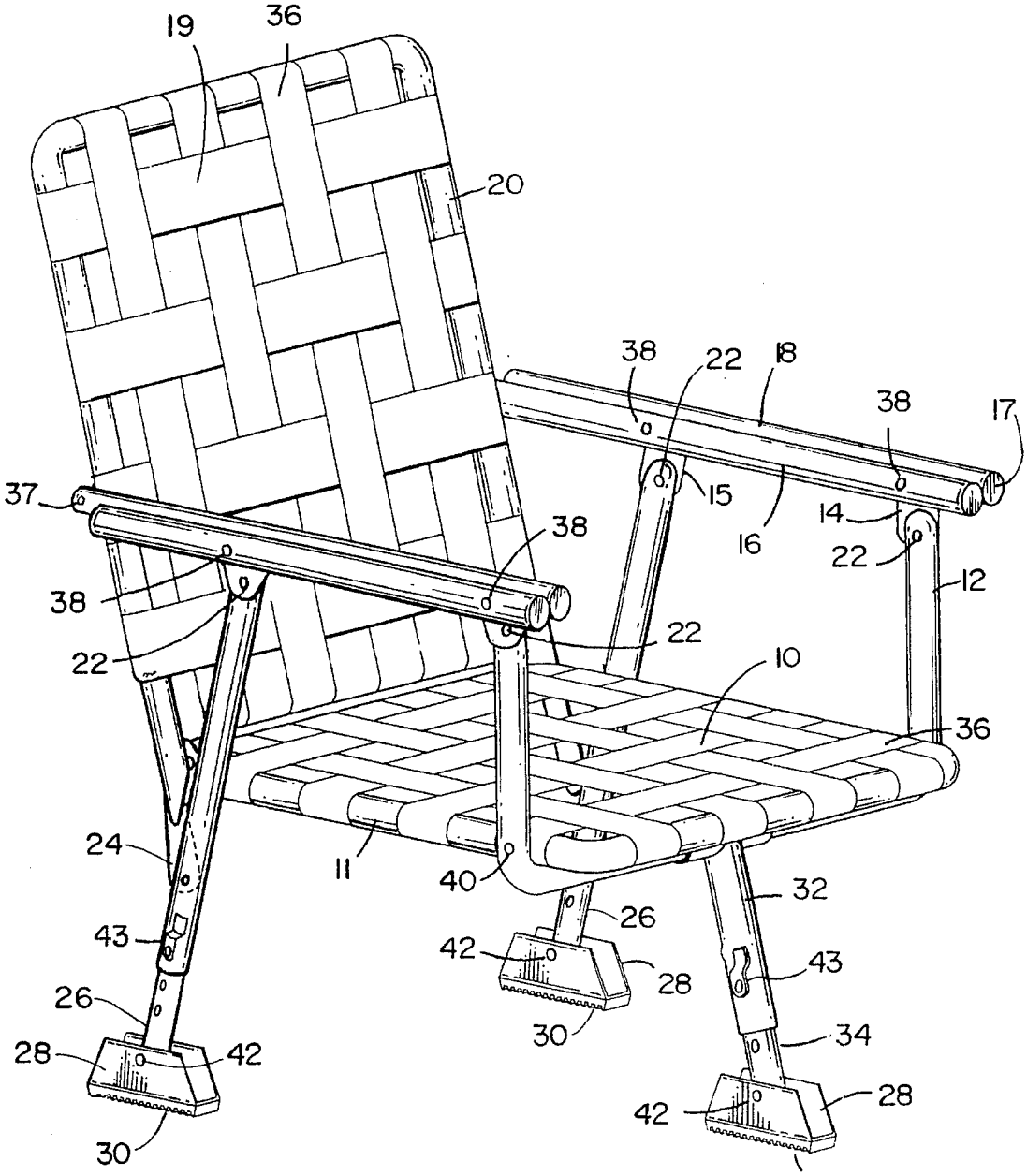
FIG. 1 is an isometric drawing of the preferred embodiment of the present invention.

FIG. 1 is an isometric view of the preferred embodiment of the hillside chair. A seat 10 to form a seating surface comprises a seat frame 11 covered with webbing 36. A front frame member 12 is attached to the seat frame 11 with suitable fasteners 40. Both ends of the front frame member 12 have front arm brackets 14 attached with suitable fasteners 22. The two front arm brackets 14 are attached to arms 17 with suitable fasteners 38. Each arm 17 comprises two pieces, an inner arm tube 16 and an outer arm tube 18. The two arms 17 are attached to a back 19 to support the arms of the user with suitable fasteners 37. A back 19 to provide back support to a user comprises a back frame 20 and webbing 36. Each arm 17 has a rear arm bracket 15 attached with a suitable fastener 38. The rear arm brackets 15 are connected to rear legs 24 with suitable fasteners 22 A rear leg extension 26 fits inside each rear leg 24. A front leg 32 is attached to the seat frame with suitable fasteners, not shown. A front leg extension 34 fits inside the front leg 32. Each rear leg 24 and the front leg 32 is fitted with a locking pin assembly 43, which is shown in more detail in FIG. 3. A pivoted leveling foot 28 for distributing leg load over an area is attached to each rear leg extension 26 and the front leg extension 34 with a suitable fastener 42. A bottom gripping surface 30 is attached to the bottom of each leveling foot 28 to prevent slippage of the foot on a supporting surface.

Figure 2:
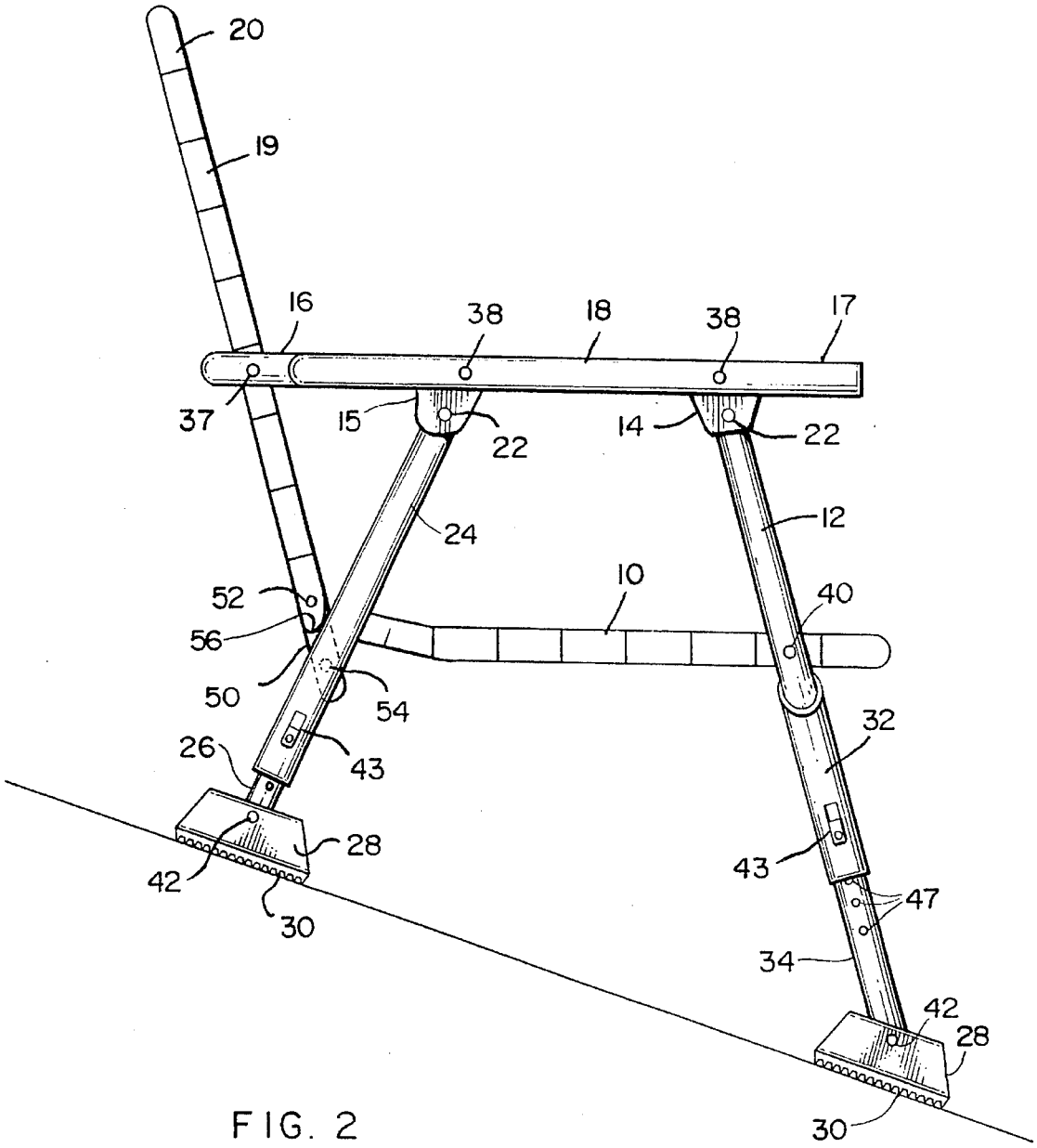
FIG. 2 is a side elevation of FIG. 1.

FIG. 2 is a side elevation of the preferred embodiment of the hillside chair. A plurality of apertures 47 penetrate the front leg extension 34 and both rear leg extensions 26. Two seat back connectors 50 attach the back 19 to the rear legs 24 using suitable connectors 52 and 54. The bottom surface 56 of the back frame 20 impinges upon the rear legs 24 when the chair is fully opened.

FIG. 3 is a detail of the locking pin assembly 43 of FIG. 2 connecting the front leg 32 with the front leg extension 34. The same detail applies equally to the connection of the rear legs 24 with the rear leg extensions 26. A locking pin 44 fits through an aperture 45 in the front leg 32 and one of the plurality of apertures 47 in the front leg extension 34, locking the front leg 32 and the front leg extension 34 together. A locking pin spring tab 46 holds the locking pin 44 in place. The locking pin spring tab is fastened to the front leg with a weld or other suitable fastening means, not shown. Pulling out on the locking pin 44 disengages it from the aperture 47, allowing repositioning of the front leg extension such that the locking pin 44 engages a different aperture 47 in the front leg extension 34. Other telescoping locking mechanisms known in the art could also be used.

Figure 4A:
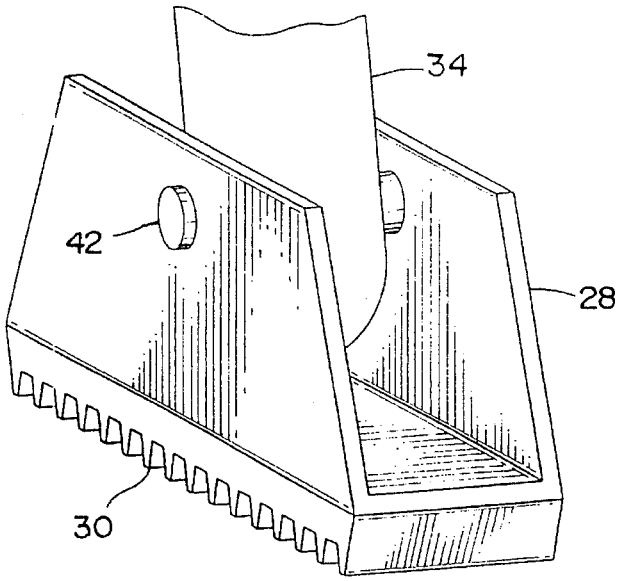
FIG. 4A is a detail of a leveling foot for the chair.

FIG. 4A is a detail of a leveling foot for the preferred embodiment of the hillside chair. The detail shown is of the leveling foot on the front leg of the chair. The same detail is applicable for the leveling feet on the rear legs. A leveling foot 28 is attached to the front leg extension 34 with a suitable fastener 42, such as a bolt or a pin. The suitable fastener 42 is assembled loosely to allow free swiveling or pivoting of the leveling foot about the longitudinal axis of the suitable fastener 42. A grooved resilient bottom surface of rubber or soft plastic 30 is bonded to the bottom of the leveling foot 28.

Figure 4B:
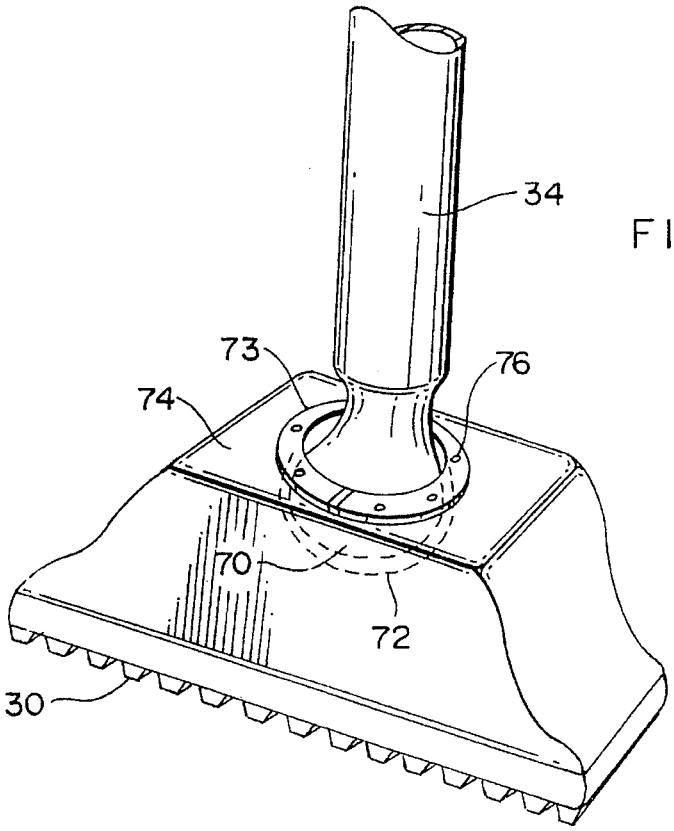
FIG. 4B is a detail of a leveling foot utilizing a ball and socket joint.

FIG. 4B is a detail of a leveling foot utilizing a ball and socket joint. The detail shown is of the leveling foot on the front leg of the chair. The same detail is applicable for the leveling feet on the rear legs. The front leg extension 34 is fitted with a ball 70 at its lower end. A leveling foot 74 includes a socket 72, which receives the ball 70. Split retaining ring 73 retains ball 70 in socket 72 and is attached with fasteners 76. A grooved resilient bottom surface of rubber or soft plastic 30 is bonded to the bottom of the leveling foot 74.

The leveling feet of FIGS. 4A and 4B allow the bottom surface of the foot to conform to the local surface grade or slope of the ground to distribute the leg load over the full surface area of the bottom of the foot. This feature will reduce the possibility of the legs sinking in soft ground conditions common on banks of rivers and lakes. The bottom surface of the leveling foot is of an area sufficient to support the load on the leg on a soft surface such as sand. Typically, the area of the bottom surface of the leveling foot will be four to twenty square inches. The resilient bottom surface of the foot effectively grips hard surfaces such as rock, stone or concrete.

Figure 5:
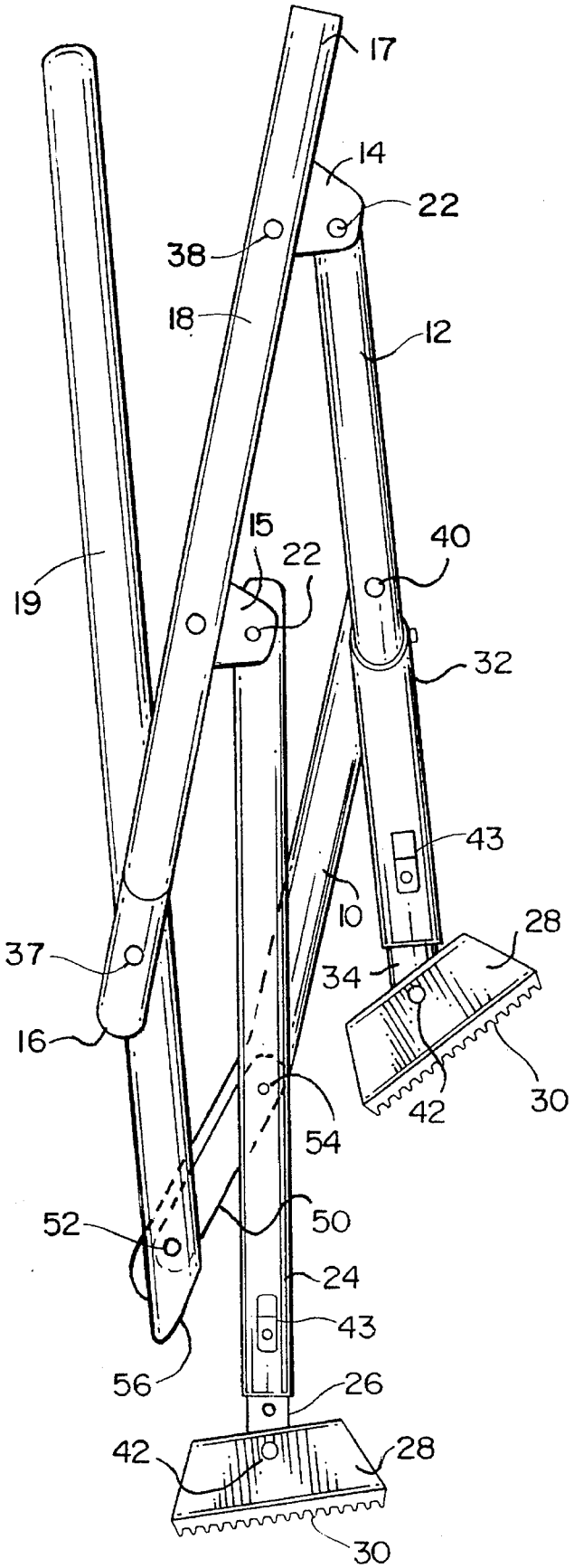
FIG. 5 is a side elevation of the chair in a folded position.

FIG. 5 is a side elevation of the preferred embodiment of the present invention in a folded configuration for carrying or storage.

Figure 6:
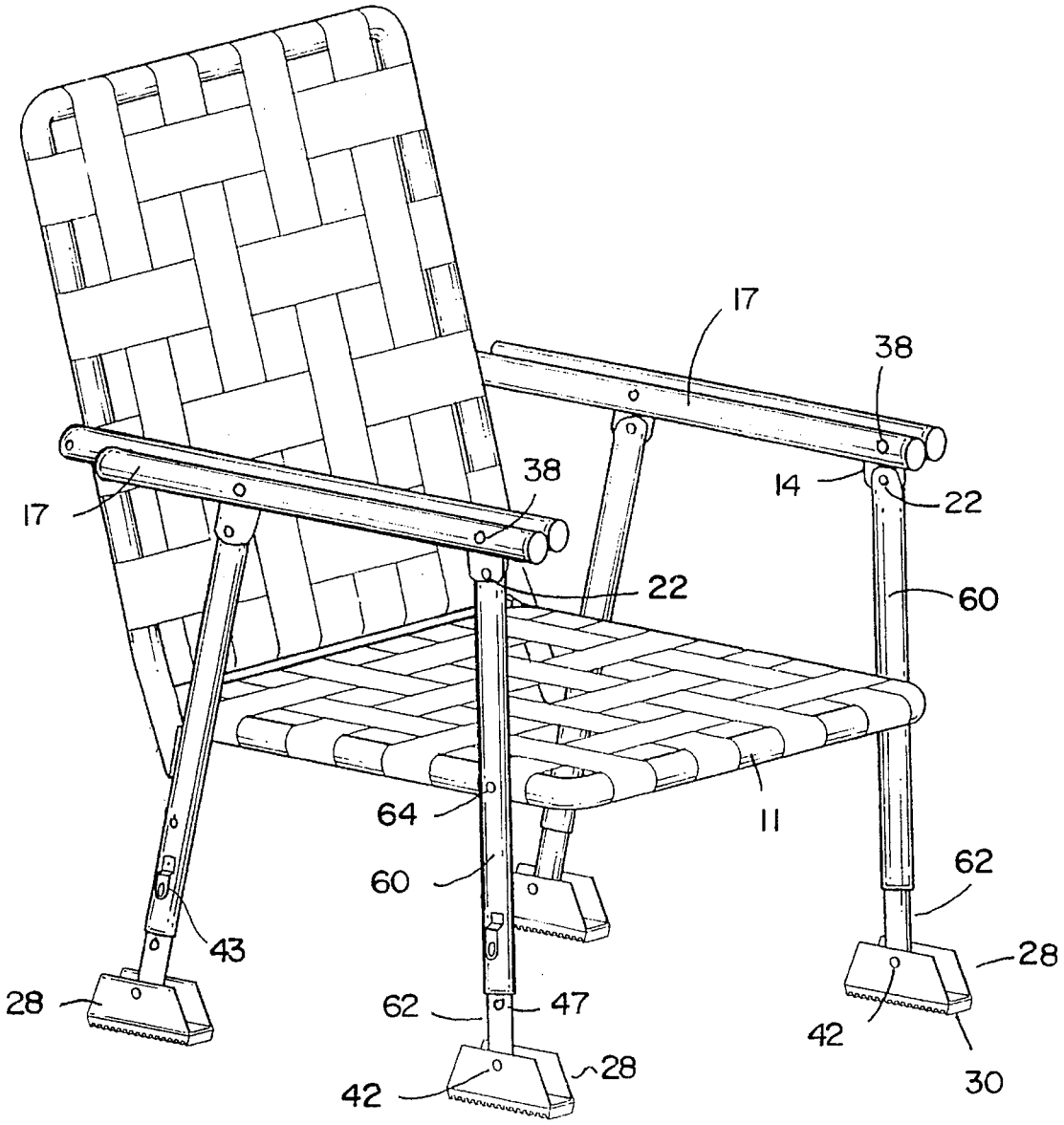
FIG. 6 is an isometric view of an alternative embodiment of a hillside chair having four legs.

FIG. 6 is an isometric view of an alternative embodiment of the present invention in which the chair comprises four legs. The front legs 60 are attached to the arm brackets 14 with suitable fasteners 22. The front legs 60 are similarly attached to the seat frame 11 with suitable fasteners 64. A locking pin assembly 43 is attached to each front leg 60. A front leg extension 62 telescopes inside each front leg 60. The front leg extensions 62 are penetrated by a plurality of apertures 47. A leveling foot 28 is attached to the end of each front leg extension 62 with a suitable fastener 42. A bottom gripping surface 30 is attached to the bottom of each leveling foot 28 to prevent slippage of the foot on a supporting surface.

FIG. 7 shows an alternative arm design having an integral storage area. Arm 70 comprises a storage area 71 which may contain compartments (not shown). Lid 72 covers storage area 71 and is pivoted at hinge 73 to an opened or closed position. Catch 74 retains lid 72 in the closed position by engaging a depression in the inside of storage area (not shown). The storage area may be used for storing fishing tackle, sewing items, or other articles which may be used together with the chair.

The chair structure described above defines an interconnecting means for positioning and supporting the seat, back, arms and legs in an operating position as shown in FIGS. 1, 2, and 6 for seating a user, and a folding position as shown in FIG. 5 for positioning and supporting the seat, back, arms, and legs in close proximity for storage and carrying the chair.

In the preferred embodiment, three legs (two rear legs and one front leg as shown in FIG. 1) are used, because rocking is reduced and adjustment is simplified. In the alternative embodiment, four legs (two front legs and two rear legs) are employed to improve structural stiffness of the chair.

Accordingly the reader will see that the hillside chair comprises the following advantages:

it is simple and can be manufactured at low cost, it provides a comfortable seat, back, and arm rests, it provides a comfortable and secure seating posture on flat, sloping, or uneven ground, it is easily adjustable, it can be easily folded for transport and storage, and it contains an integral storage area for small items.

Although the description above contains many specifications, these should not be construed as limiting the scope of the invention but as merely providing illustrations of some of the presently preferred embodiments of this invention. For example, the principles disclosed herein are illustrated as applied to a chair but they would apply as well to a lounge chair or a small table.

Thus the scope of the invention should be determined by the appended claims and their legal equivalents, rather than by the examples given.

I claim:

1. A chair for use on uneven surfaces comprising:

(a) a seat to form a seating surface;

(b) a back to provide back support to a user;

(c) two armrests to support the arms of the user;

(d) three legs to support the chair, one of said three legs attached to a central portion of a generally "U" shaped support, the "U" shaped support pivotally attached to said two armrests;

(e) an individual length adjustment means to individually adjust the length of each of said three legs, the adjustment means comprising a leg extension and a leg extension locking means;

(f) a leveling foot on said each of said three legs for conforming a bottom surface of the foot to a local ground slope, the leveling foot comprising a grooved resilient bottom surface and attached pivotally to said leg extension; and (g) an interconnecting means for positioning and supporting the seat, back, armrests and legs in an operating position for seating of the user, and a folding position for positioning and supporting the seat, back, armrests, and legs in close proximity for storage and carrying of the chair.

2. The chair of claim 1 wherein the leveling foot is attached pivotally to said leg extension by an elongated fastener, the leveling foot pivoting about the elongated fastener.

3. The chair of claim 1 wherein the leveling foot is attached pivotally to said leg extension by a ball and socket joint.

4. The chair of claim 1 comprising a storage compartment in at least one of said two armrests.

* * * * *